United States Patent [19]

Ogawa

[11] 4,170,840

[45] Oct. 16, 1979

[54] TOY VEHICLE DOLL ASSEMBLY

[75] Inventor: Iwakichi Ogawa, Kashiwa, Japan

[73] Assignee: Takara Co., Ltd., Tokyo, Japan

[21] Appl. No.: 881,016

[22] Filed: Feb. 24, 1978

[51] Int. Cl.[2] ..... A63H 3/16

[52] U.S. Cl. ..... 46/22; 46/103

[58] Field of Search ..... 46/16, 17, 22, 99, 106, 46/20

[56] References Cited

U.S. PATENT DOCUMENTS

| | | | |
|---|---|---|---|
| 2,475,306 | 7/1949 | Beder | 46/22 |
| 3,401,485 | 9/1968 | Goodrum | 46/120 |
| 3,939,600 | 2/1976 | Eid | 46/17 |
| 3,995,395 | 12/1976 | Rahmstorf | 46/22 |

*Primary Examiner*—Louis G. Mancene

*Assistant Examiner*—Robert F. Cutting

*Attorney, Agent, or Firm*—Jackson, Jones & Price

[57] ABSTRACT

A toy assembly which includes an articulated doll and subcomponent parts capable of forming a vehicle is provided. The doll can be configured to represent a humanoid with removable appendages. A front carriage member supporting a pair of wheels can be removably attached to the legs of the doll while a rear carriage member can be removably attached to the back of the doll body. A supplemental connector member can be further attached directly to the front and rear carriage member to complete the vehicle. Finally, a magnetic ball can be provided in a cavity of the doll body for positioning by a magnetic wand adjacent an aperture communicating with the cavity.

12 Claims, 7 Drawing Figures

FIG. 1
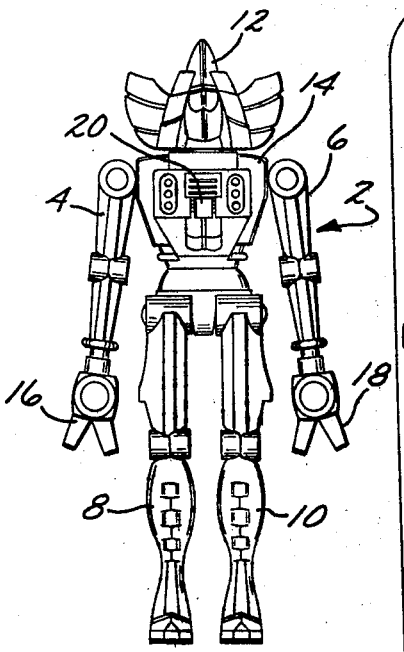
FIG. 2
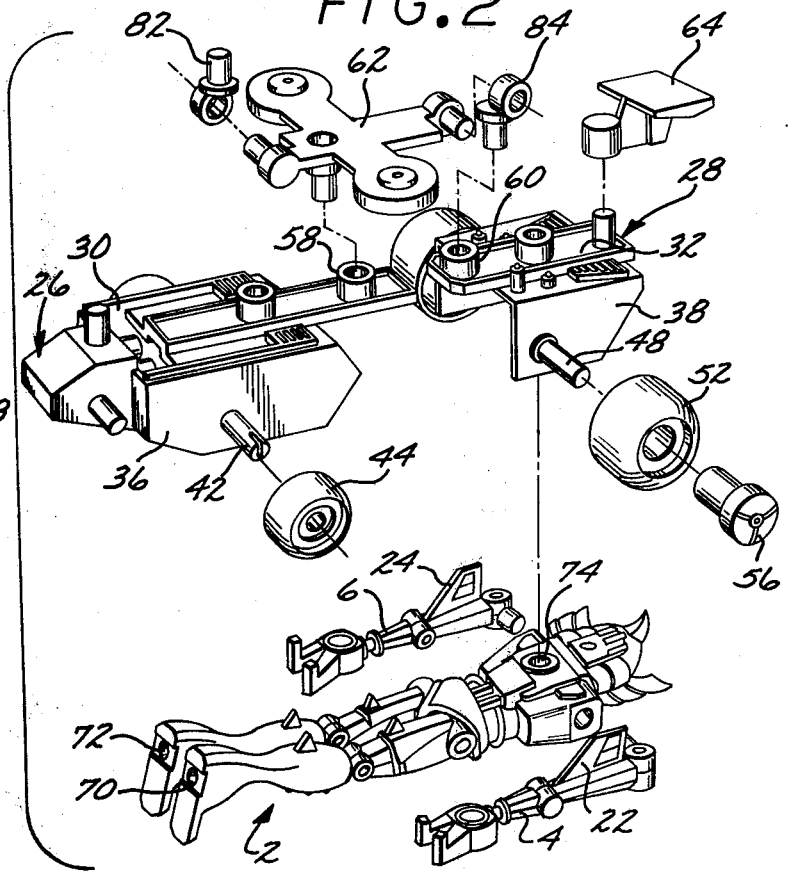
FIG. 3
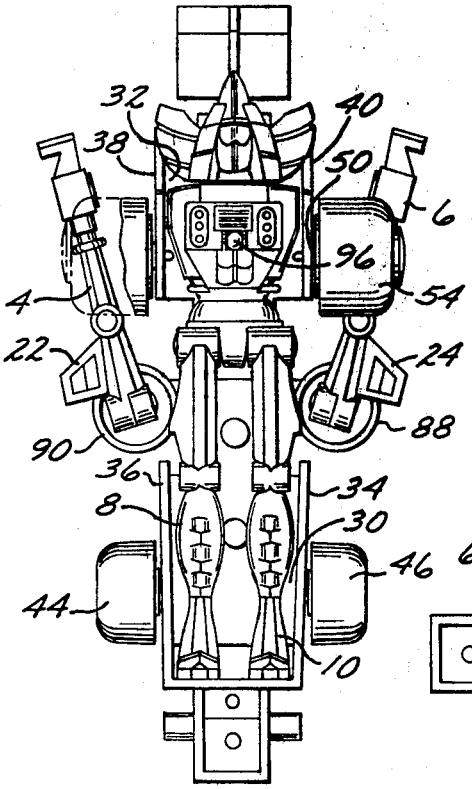
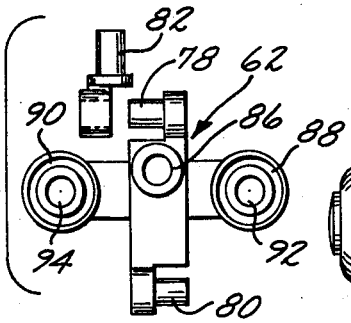
FIG. 6
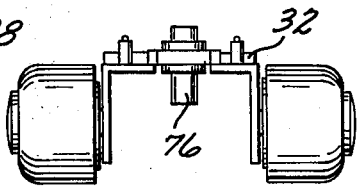
FIG. 4
FIG. 5
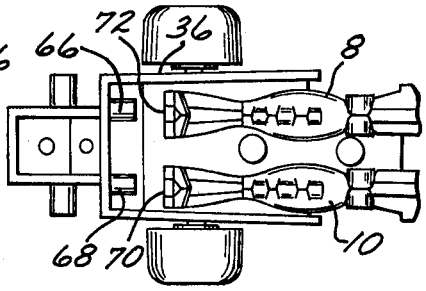
FIG. 7
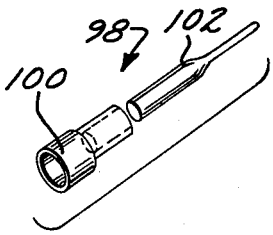

TOY VEHICLE DOLL ASSEMBLY

BACKGROUND OF THE INVENTION

1. Field of the Invention

The present invention is directed to a reconfigurable toy assembly and more particularly to a humanoid like doll that is capable of forming the frame of a vehicle.

2. Description of the Prior Art

Various forms of toy robots have been provided in the prior art that have included a vehicle mode of operation such as U.S. Pat. No. 3,587,191, U.S. Pat. No. 3,648,408, U.S. Pat. No. 3,128,575, U.S. Pat. No. 3,553,885 and U.S. Pat. No. 4,051,623.

Generally, the identity of prior art robot dolls are maintained in their vehicle configurations by providing tracks on an appendage of the robot or by actually supplementing the robot with a separate vehicle. Finally, most of the robot dolls having a locomotion mode of operation are relatively expensive with self-contained motors.

There is still a demand in the prior art for innovative robot vehicle assemblies that maximize the play option configurations available to the child in a relatively economical manner.

SUMMARY OF THE INVENTION

A toy assembly capable of forming a vehicle from an articulated robot doll and individual subcomponent parts are provided. The toy doll is configured to simulate a humanoid with arm and leg appendages. The body portion of the doll includes a cavity having exterior access through an aperture on the chest. A magnetizable spherical member can be freely positioned within the cavity and is capable of being supported adjacent the aperture so that it is visible from the exterior of the chest. A front carriage member is provided with removable wheels and is capable of being attached to the doll leg appendages. A rear carriage member also includes removable wheels and is capable of being attached to the back of the body of the doll when its removable arm appendages are removed. A supplemental connector member can be further attached to both the front and rear carriage members and can also pivotally support the separated arm appendages in the vehicle configuration. Thus, the body and legs of the articulated doll form a lower frame member for the front and rear carriage members in the vehicle mode of operation.

The objects and features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

FIG. 1 is a front elevational view of the articulated doll;

FIG. 2 is an upper front side exploded perspective view of the vehicle mode of operation of the present invention;

FIG. 3 is a bottom view of the vehicle mode of the invention;

FIG. 4 is a bottom view of the connector member;

FIG. 5 is a partial bottom view of the front carriage member and legs of the doll;

FIG. 6 is a front elevational view of the rear carriage member, and

FIG. 7 is an exploded perspective view of the magnetic wand.

DESCRIPTION OF THE PREFERRED EMBODIMENTS

The following description is provided to enable any person skilled in the toy industry to make and use the invention and sets forth the best modes contemplated by the inventor of carrying out this invention. Various modifications, however, will remain readily apparent to those skilled in the above art, since the generic principals of the present invention have been defined herein specifically to provide a relatively economical and easily manufactured toy vehicle toy assembly.

Referring to FIG. 1, the articulated doll 2 has a humanoid robot configuration which includes removable upper appendages 4 and 6 which are configured to simulate arms. Lower appendages 8 and 10 are configured to simulate legs. These respective appendages can have articulated joints to permit life-like movement and positioning of the respective appendages. A head appendage 12, can have a female aperture (not shown) for removable positioning on a male stud (not shown) appropriately positioned on the body member 14. Respective arm appendages 4 and 6 can each have a terminal member 16 and 18 of a V-shaped hook configuration with a central bore mounted therein. A body member 14 includes an interior hollow cavity (not shown) that is ported by an aperture 20 centrally positioned on the simulated chest of the body member 14.

Preferably, the articulated doll 2 as well as the other component parts of the toy assembly are formed from a molded plastic, although metal pins or hinges can be utilized to help realize the appropriate life-like movement of the simulated arm and leg appendages. Since the articulated doll 2 can be formed from plastic, various decorative exterior features such as the flanges 22 and 24 on the rear portion of the arm appendages 4 and 6, can be subjectively provided.

Referring to FIG. 2, a front carriage member 26 has an upper base support plate 30 and a pair of downwardly extending side panels 34 and 36. Each of the side panels support a split end axle stud such as the stud 42 shown in FIG. 2. A pair of wheels 44 and 46 can be press-fitted on the split end axle studs to secure them for relative rotation to provide a means of translation for the front carriage member.

A rear carriage member 28 also includes an upper support base plate 32 and a pair of vertically downward extending side panels 38 and 40. Cylindrical axle studs 48 and 50 are cantilevered horizontally outward from their respective side panels 38 and 40 to receive respective wheels 52 and 54. An axle coupler such as the coupler 56 shown in FIG. 2, can be used to hold the wheels onto their respective axle studs.

Both the front carriage member 26 and the rear carriage member 28 can include various female apertures such as 58 and 60 which collectively form means for attachment of the front and rear carriage members to a supplemental connector member 62. Additionally, various male studs can extend outward from the surface of the respective carriage members for appending accessory items such as a wind spoiler member 64.

The assembled vehicle mode of operation can be seen in a bottom view of FIG. 3 wherein the articulated doll 2 with its respective arm appendages 4 and 6 removed form the undercarriage frame of the vehicle. Referring to FIG. 5, the manner of connection can be seen wherein a pair of male studs 66 and 68 extend parallel and between the respective side panels 34 and 36 of the front carriage member 26 and form means for attachment to a pair of apertures 70 and 72 at the bottom of the simulated feet of the articulated dolls legs 8 and 10 respectively. The back of the body member 14 also has a female aperture 74 for receiving a downwardly extending male stud 76 from the bottom surface of the base support plate 32 of the rear carriage member 28. These respective male studs and female apertures provide a friction press fit which can be repetitively used during reconfiguration of the subcomponent parts and the articulated doll.

The connector member 62 has a cross like configuration with a pair of male studs 78 and 80 that are adapted to support extension coupler members 82 and 84. A downwardly extending stud 86 from the bottom of the connector member 62 is capable of attachment to the female aperture 58 on the front carriage member 26. The extension coupler member 84 is likewise adapted to perform a male coupling function with the female aperture 60 on the rear carriage member 28. The attachment of the connector member 62 to the front and rear carriage members adds strength and rigidity to the resultant vehicle.

Referring to FIG. 4, the bottom view of the connector member 62 discloses a pair of cantilevered side support posts 88 and 90 having respective female apertures 92 and 94 that are capable of supporting the arm appendages during the vehicle mode of operation.

The cavity in the chest of the body member 14 is capable of freely supporting a spherical magnetizable member 96 which can be positioned adjacent the aperture 20 by a magnetic wand 98 as shown in FIG. 7. The magnetic wand 98 can have a magnetic head 100 with a female aperture for receiving an extension member 102. The circumference of the extension member 102 permits a frictional fit within the bores of the terminal arm portions 16 and 18.

As can be readily appreciated, the articulated doll 2 alone can provide an enjoyable toy for a child. The respective arm and leg appendages can be positioned to simulate various action poses or movement to the doll. However, by the removal of the arm appendages 4 and 6 the remainder of the articulated doll 2 can be combined with a front carriage member 26 and a rear carriage member 28 as shown in FIG. 2 to form a vehicle with the articulate doll forming the major portion of the frame undercarriage. A supplemental connector member 62 can provide additional rigidity to the vehicle structure by interconnecting across the upper surface of the front and rear carriage members 26 and 28. The arm appendages 4 and 6 can additionally be removably coupled with appropriate female apertures 94 and 92 on the connector member 62 in the vehicle mode of operation.

To add an additional play option, a magnetic wand 98 is capable of positioning a magnetizable ball 96 to appear adjacent the aperture 20 in the chest of the articulated doll 2.

The wind spoiler 64 can be mounted on an upwardly extending stud on the rear carriage member 28 to further simulate a vehicle configuration.

As can be readily appreciated the particular configuration of the doll and its appendages and the provision of various male and female coupling members on both the doll and the front and rear carriage members permits numerous play options which are only limited by the imagination of the child.

In view of the versatile capabilities of the subcomponent parts and the articulated doll of the present invention, and the ability of people skilled in this field to create variations once disclosed the generic principals of the present invention, the scope of the present invention should therefore be measured solely from the following claims wherein I claim:

1. A toy assembly capable of forming a vehicle from individual sub-component parts comprising;
   - an articulated doll having appendages configured to simulate arms and legs;
   - a front carriage member having a first support member and a first pair of wheels for translation across a support surface;
   - a rear carriage member having a second support member and a second pair of wheels for translation across a support surface, and
   - connector means on the articulated doll for operatively appending the respective front and rear carriage support members across the articulated doll wherein it forms an undercarriage frame for a vehicle for movement across the support surface by the respective pairs of wheels, the undercarriage frame positioned approximately parallel to the support surface and beneath the respective support members.

2. The invention of claim 1 further including a connector member having means for attachment to both the front and rear carriage member.

3. The invention of claim 1 wherein the front and rear carriage members have respectively a pair of side panels to support their respective pairs of wheels for translation, the doll extending beneath each respective base support plate and between each respective pair of side panels.

4. The invention of claim 2 wherein the simulated arm appendages are removably attached to the doll and the connector member further has means for supporting the arm appendages in a vehicle mode of operation.

5. The invention of claim 2 further including a wind spoiler member attached to one of the carriage members.

6. A toy doll assembly capable of forming a frame for a pair of wheel assemblies comprising;
   - a base member configured to simulate the body of a humanoid including a cavity positioned in the base member and having an aperture communicating with the cavity;
   - a spherical member freely positioned within the cavity and capable of being supported adjacent the aperture so that it is visible from the exterior of the base member;
   - means on the base member for operatively supporting one of the wheel assemblies;
   - a first pair of appendages removably connected to the base member and configured to simulate arms;
   - a second pair of appendages articulatively connected to the base member and configured to simulate legs, and
   - means on the second pair of appendages for operatively supporting the other of the wheel assemblies.

7. The invention of claim 6 wherein the means on the base member includes an aperture on the back of the simulated body and the means on the second pair of appendages includes an aperture of each of the leg appendages.

8. The invention of claim 6 wherein the spherical member is made from a magnetizable material and further including a magnet to position the spherical member adjacent the cavity aperture in the simulated body.

9. The invention of claim 6 wherein each of the simulated arm appendages includes a terminal V-shaped member having a bore.

10. A toy doll assembly capable of forming both an articulated doll and an undercarriage frame for a vehicle comprising;

a base member configured to simulate the body of a humanoid;

a pair of wheel assemblies having respective support members;

a first connecting means for interconnecting the base member in a substantially horizontal position with one of the wheel assemblies including a press fit aperture on one of the wheel assemblies and the base member and a stud configured to fit the press fit aperture on the other;

a first pair of appendages removably connected to the base member and configured to simulate arms;

a second pair of appendages articulatively connected to the base member and configured to simulate legs, and second connecting means for interconnecting one end of the second pair of appendages and the other wheel assembly, the respective support members capable of extending over the base member and second pair of appendages when the first pair of appendages are removed and the toy doll is configured as a horizontal undercarriage frame and connected to the pair of wheel assemblies by the first and second connecting means for operation as a vehicle.

11. The invention of claim 10 further including a connector member having means for attachment to both wheel assemblies to provide additional rigidity to the vehicle.

12. The invention of claim 10 wherein each of the simulated arm appendages includes a terminal V-shaped member having a bore.

* * * * *